United States Patent [19]

Quimby

[11] Patent Number: 4,838,737

[45] Date of Patent: Jun. 13, 1989

[54] PIER FOR SUPPORTING A LOAD SUCH AS A FOUNDATION WALL

[76] Inventor: Harold L. Quimby, 8564 E. Monmouth Pl., Denver, Colo. 80327

[21] Appl. No.: 640,845

[22] Filed: Aug. 15, 1984

[51] Int. Cl.[4] ..... E02D 5/22; E02D 5/60

[52] U.S. Cl. ..... 405/230; 405/229; 405/234; 405/216

[58] Field of Search ..... 405/230, 229, 231, 239, 405/243, 216, 61, 211, 218, 219, 220, 221, 228; 52/263, 299, 301, 40, 295, 292, 105, 283

[56] References Cited

U.S. PATENT DOCUMENTS

| | | | |
|---|---|---|---|
| 574,729 | 1/1897 | Gillespie | 405/230 |
| 976,182 | 11/1910 | Jones | 52/283 X |
| 1,567,301 | 12/1925 | Ross | 52/40 |
| 1,629,947 | 5/1927 | Blumenthal | 405/243 |
| 2,374,624 | 4/1945 | Schwendt | 52/301 X |
| 3,060,694 | 10/1962 | Holmes | 405/239 |
| 3,170,299 | 2/1965 | Clarke | 405/61 |
| 3,180,099 | 4/1965 | Mikolajczyk et al. | 405/216 |
| 3,370,432 | 2/1968 | Butler et al. | 405/216 |
| 3,396,546 | 8/1968 | Pleuger | 405/243 |
| 3,442,089 | 5/1969 | Sollay | 405/243 |
| 3,473,285 | 10/1969 | Reiland | 52/295 X |
| 3,540,175 | 11/1970 | Hann | 52/299 X |
| 3,606,231 | 9/1971 | Kilborn | 52/292 X |
| 3,630,037 | 12/1971 | Howard | 405/231 X |
| 3,713,259 | 1/1973 | Tkach | 52/296 X |
| 3,796,055 | 3/1974 | Mahony | 405/230 |
| 4,040,260 | 8/1977 | Pryke | 405/243 X |
| 4,070,867 | 1/1978 | Cassidy | 405/231 |
| 4,114,388 | 9/1978 | Straub | 405/216 |
| 4,217,738 | 8/1980 | Smith | 52/296 X |
| 4,452,028 | 6/1984 | Norton et al. | 52/295 X |
| 4,464,083 | 8/1984 | Wathey | 405/216 |
| 4,614,070 | 9/1986 | Idland | 52/295 X |

FOREIGN PATENT DOCUMENTS

| | | | |
|---|---|---|---|
| 0119827 | 6/1985 | Japan | 405/230 |
| 2047303 | 11/1980 | United Kingdom | 405/230 |

*Primary Examiner*—Dennis L. Taylor

[57] ABSTRACT

A pier adapted to support a load such as a foundation wall comprises a concrete pillar, a support tube oriented substantially perpendicular to and on top of the pier, a pair of threaded rods embedded in the pillar and extending through the support tube, and four threadably mounted on the threaded rods to secure the support tube to the pier. A portion of the support tube extends beyond the periphery of the pillar and is disposed below the load, whereby the load is supported by the extending portion of the support tube. A slippery, plastic liner surrounds the upper portion of the concrete pillar so that swelling of soil surrounding the liner is inhibited by the liner from displacing the concrete pillar.

20 Claims, 2 Drawing Sheets

PIER FOR SUPPORTING A LOAD SUCH AS A FOUNDATION WALL

BACKGROUND OF THE INVENTION

The present invention relates to a pier adapted to support a foundation wall, an extensible steel column, or the like.

The foundations of many buildings are supported by one or more concrete piers extending several feet into the ground, often to bedrock. The purpose of such piers is to support and stabilize the building's foundation where the weight of the building is great, where the soil tends to move or slide, or where the soil swells and shrinks due to ground moisture. Sometimes the piers become questionable in their ability to provide sufficient support and stability. Such defective piers can result from a variety of causes such as improper construction, improper strength of concrete or other materials used in forming the pier, and displacement of the pier due to soil movement.

The repair or replacement of defective piers is extremely expensive because one must excavate soil directly beneath the foundation wall or other load-supporting components and then repair or replace the defective pier while at the same time supporting the load by other support means. The present invention was developed primarily as a result of efforts to create an easy, inexpensive way to provide support for foundation walls and the like which are inadequately supported by existing, defective piers.

SUMMARY OF THE INVENTION

The present invention is directed to a pier adapted to support a load such as a foundation wall. The pier comprises a concrete pillar, a support tube oriented substantially perpendicular to and on top of the pier, a pair of threaded rods embedded in the pillar and extending through the support tube, and four nuts threadably mounted on the threaded rods to secure the support tube to the pier. A portion of the support tube extends beyond the periphery of the pillar and is disposed below the load, whereby the load is supported by the extending portion of the support tube. A slippery, plastic liner surrounds the upper portion of the concrete pillar so that swelling of soil surrounding the liner is inhibited by the liner from displacing the concrete pillar.

BRIEF DESCRIPTION OF THE DRAWINGS

The invention will be described with reference to the accompanying drawings, wherein.

DESCRIPTION OF THE PREFERRED EMBODIMENT

Figure 1:
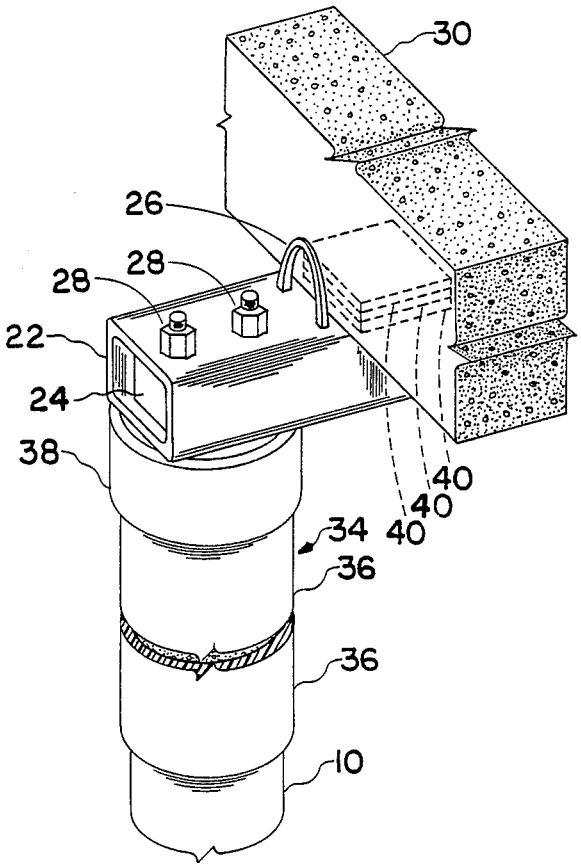
FIG. 1 is a perspective view of a pier constructed according to an embodiment of the present invention shown supporting a foundation wall.

Referring now to the drawings wherein like reference numerals and symbols refer to the same item, there is shown in FIGS. 1 through 4, a pier constructed according to a preferred embodiment of the present invention. The piers include a pillar 10 preferably having a cylindrical shape and formed of concrete. Typically the pillar 10 is several feet in length and often extends into the bedrock.

Embedded in the lower portion of the pier 10 are two or more steel reinforcement bars (not shown) that extend parallel to the longitudinal axis of the pier 10 and are laterally separated in a well known manner by tying the reinforcement bars to a plurality of metal spacing grids. A pair of steel threaded rods 12, 14 are embedded in the upper portion of the pillar 10. The threaded rods 12, 14 are parallel with the longitudinal axis of the pillar, 180 degrees apart from each other and equidistant from the longitudinal axis of the pillar 10. The threaded rods 12, 14 are maintained in a laterally spaced condition by means of a series of spreaders 16 laterally extending between and contacting the threaded rods 12, 14 and by means of a high strength wire 18 wrapped around the reinforcement bars 12, 14 along the embedded portions thereof. The lower ends of the threaded rods 12, 14 are tied to the upper ends of the reinforcement bars by means of wires (not shown). A nut 20 is threadably mounted on a corresponding threaded rod 12, 14 and is embedded within the pier 10 at the surface of the top longitudinal end thereof. The upper end of each threaded rod 12, 14 extends an equal, short distance above the top longitudinal end of the pier 10.

Figure 2:
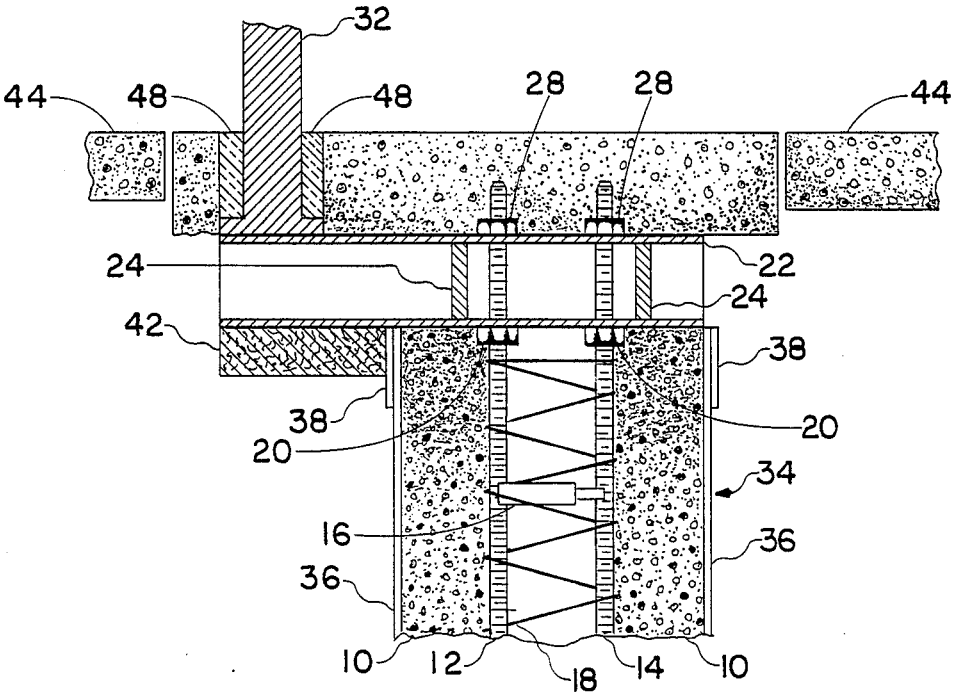
FIG. 2 is a cross-sectional view of a pier constructed according to another embodiment of the present invention shown supporting an extensible steel column.
Figure 3:
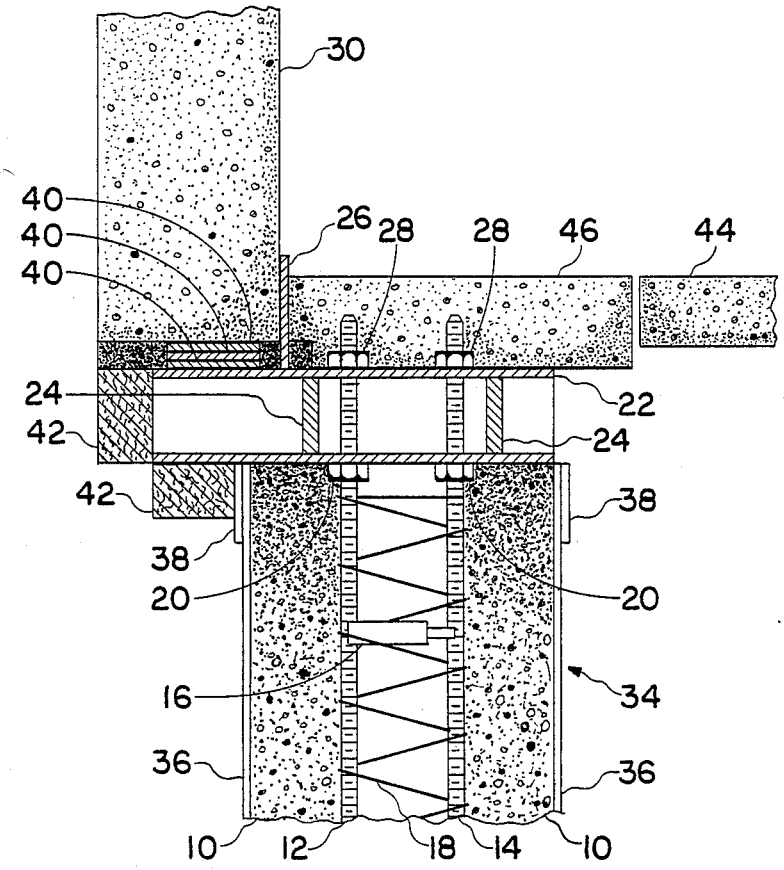
FIG. 3 is a cross-sectional view of the pier shown in FIG. 1.
Figure 4:
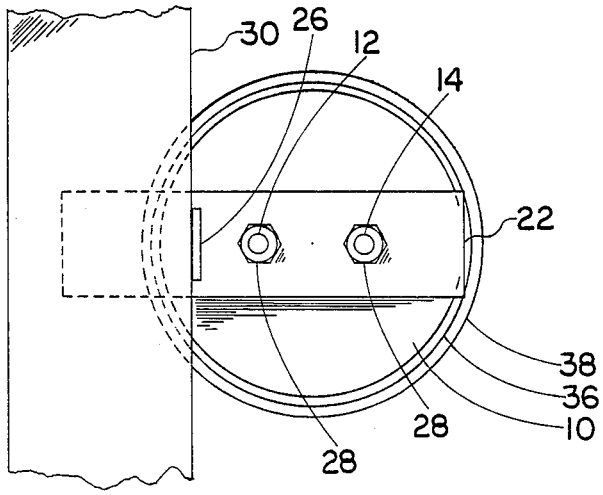
FIG. 4 is a schematic top view of the pier shown in FIG. 3.

The upper end of each threaded rod 12, 14 is adapted to extend through opposing walls of a support tube 22. The support tube 22 bears a rectangular cross-section as best shown in FIG. 1, and is fashioned of steel coated with epoxy or similar corrosion protection material. A pair of steel plates 24 extend laterally across the interior of the support tube 22 and act as bracing between the opposing walls of the support tube 22. As best shown in FIGS. 2 and 3, the threaded rods 12, 14 extend through the support tube 22 between the plates 24. A steel, U-shaped arch 26 is mounted on and extends from the upper wall of the support tube 22 and is positioned approximately coextensive with the periphery of the pillar 10.

A nut 28 is threadably mounted on the end of each threaded rod 12, 14. Each nut 28 abuts the outer surface of the top wall of the support tube pier and causes the lower wall of the support tube 22 to rest against the top longitudinal end of the pillar 10. The longitudinal axis of the support tube 22 is perpendicular to the longitudinal axis of the pier 10 and is coincident with the plane formed by the threaded rods 12, 14 and the longitudinal axis of the pier 10. A portion of the support tube 22 extends beyond the periphery of the pier 10 and is adapted to support a structure such as a foundation wall 30 or an adjustable steel column 32.

An additional aspect of the present invention is the provision of a liner 34 surrounding the periphery of the top portion of the pillar 10. The liner comprises a plastic tube 36, which protects the pillar 10 from being affected by forces caused by the movement or swelling of soil in the region surrounding the liner. It is believed that the liner tube 36 provides a low coefficient of friction so that the moving soil either slides along the liner tube 36 or causes the liner tube 36 to move along the pillar 10, thereby inhibiting displacement of the pillar 10 due to the movement of surrounding soil. Materials having coefficients of friction in the range of 0.1 to 0.5 are generally suitable as liner tubes, and the lower the coefficient of friction, the better the material is suited to function as a liner tube. Experiments have been performed on several materials to determine their performance as liners: a material known as "Polytube" supplied by ITT Grinnell, polyethylene in both sheet and film form and in both high density and low density, polyvinylchloride in varying thicknesses, styrene, polycarbonate, and polyester. Of these materials, a polyester sold under the trade name "Mylar" by DuPont has been found to be most effective.

The liner 34 also includes a stiffening tube or collar 38 surrounding the uppermost portion of the liner tube 36. The stiffening collar 38 serves to stiffen and shape the top of the liner 34 and to maintain the liner 34 at a proper depth in the ground, as will be explained more fully hereinafter. The stiffening collar 38 may be fashioned of any material and may be formed of the same material as and integral with the liner tube 36. A stiffening collar 38 formed of cardboard is biodegradable and over time provides a void space that may be occupied by moving or swelling soil, again inhibiting the displacement of the pillar 10. The liner 34 may be slit longitudinally or be otherwise adjustable to conform with the shape of the pillar 10.

When the pier is used to support a foundation wall 30, the pier is placed such that the U-shaped arch 26 rests against the vertical surface of the foundation wall 30 and such that the extending portion of the support tube 22 is disposed below the foundation wall 30. An appropriate number of shims 40 (three of which are shown in FIGS. 1 and 3) are placed between the bottom of the foundation wall 30 and the upper wall of the extending portion of the support tube 22. When the pier is used for supporting an extensible steel column 32, shown in FIG. 2, the column base rests upon the upper wall of the extending portion of the support tube 22. There should be no need for shims 40 in this application of the pier since the steel column 32 is adjustably extensible. In either application of the pier, a block 42 of cardboard or similar material is placed beneath the extending portion of the support tube 22. The cardboard block 42 is biodegradable and over time provides a void which may be filled by moving or shifting soil.

The pier of the present invention may be constructed and installed as follows. A portion of the floor 44 adjacent to the foundation wall 30 or the extendable steel column 32 is removed, and a vertical hole immediately adjacent to the foundation wall 30 or the extendable steel column 32 that may extend several feet into the earth's surface is dug with an auger or the like. The diameter of the hole is selected to correspond with the desired diameter of the pillar 10. A liner 34 having a diameter approximately equal to the diameter of the hole is inserted into the top of the hole, and the stiffening collar 38 of the liner 34, because the outside diameter thereof is slightly greater than the outside diameter of the liner tube 36, acts to prevent the liner 34 from dropping down into the hole. The support tube 22 is attached to the threaded rods 12, 14 by means of the nuts 20 and the nuts 28, and the threaded rods 12, 14 are connected to the reinforcement bars. The spacing grids (not shown), the spreaders 16 and the wire 18 are appropriately attached to the reinforcement bars and the threaded rods 12, 14. The assembly of the support tube 22, the threaded rods 12, 14, and the reinforcement bars is positioned in a suspended state such that the lower ends of the threaded rods 12, 14 and the reinforcement bars extend down into the hole. When the pier is used in connection with the foundation wall 30, the assembly is placed such that the U-shaped arch 26 abuts the vertical surface of the foundation wall 30, and an appropriate number of shims 40 are placed between the bottom of the foundation wall 30 and the upper wall of the support tube 22. The cardboard block 42 is then placed beneath the extending portion of the support tube 22. Thereafter, the concrete is poured into the hole and around the support tube 22. The concrete is permitted to cure for several days, and then another layer 46 of concrete is placed over the entire pier such that the top surface of the layer 46 is coextensive with the top surface of the floor 44. When the pier is used in connection with the extensible steel column, a ring 48 of polyurethane foam may surround the column base as shown in FIG. 2 prior to pouring the concrete layer 46.

It should be recognized that the liner 36 of the present invention may be used in a wide variety of piers, including those installed beneath the foundation wall 30 or the extensible steel column 32 when originally constructed. Also, the pier of the present invention may be advantageously used to support structures other than the foundation wall 30 and the extensible steel beam 32 specifically described herein.

Although particular embodiments of the present invention have been described and illustrated herein, it should be recognized that modifications and variations may readily occur to those skilled in the art and that such modifications and variations may be made without departing from the spirit and the scope of my invention. Consequently, my invention as claimed below may be practiced otherwise than is specifically described above.

I claim:

1. A pier adapted to support a load comprising:

a concrete pillar having a substantially longitudinal axis adapted for disposition within the earth's surface such that the longitudinal axis thereof is substantially vertically oriented;

a tube having a substantially longitudinal axis; and means for securing said tube to the top of said pillar such that the longitudinal axis of said tube extends substantially perpendicular to the longitudinal axis of said pillar with a portion of said tube extending beyond the periphery of said pillar and adapted to bear substantially the entire load supported by the pier, said securing means comprising at least one threaded rod embedded in said concrete pillar and wherein said rod extends upwardly through said tube, and wherein said securing means further comprises a nut adapted to be threadably mounted on said threaded rod such that said tube rests against the top of said concrete pillar.

2. A pier according to claim 1 wherein said tube is fashioned with a substantially rectangular cross section taken in a plane substantially perpendicular to the longitudinal axis of said tube.

3. A pier according to claim 2 wherein said tube substantially is formed of a ferrous metal and includes an epoxy coating.

4. A pier according to claim 1 further comprising an abutment means secured to and extending from the extending portion of said tube substantially perpendicular to the longitudinal axis of said tube, said abutment means adapted to abut the structure providing the load to be supported by the pier.

5. A pier adapted to support a load comprising:

a pillar having a substantially longitudinal axis adapted for disposition within the earth's surface such that the longitudinal axis thereof is substantially vertically oriented; and a liner comprising a plastic tube surrounding at least the upper portion of a substantial portion of the periphery of said pillar along a substantial length of the longitudinal length of said pillar, said liner having a substantially continuous and smooth interior surface abutting and contacting said pillar periphery portion, said liner displaceable and translatable relative to both said pillar and the earth's surface surrounding said liner, whereby said liner inhibits the movement or swelling of the earth's surface surrounding said liner from displacing said pillar.

6. A pier according to claim 5 wherein said liner is deformable.

7. A pier according to claim 5 wherein said plastic is polyester.

8. A pier according to claim 5 wherein said liner comprises a substantially cylindrical tube.

9. A pier according to claim 5 wherein said liner comprises a material having a coefficient of friction in the range of approximately one-tenth to one-half.

10. A pier according to claim 5 wherein said liner is slit longitudinally along at least a portion of its length.

11. A pier according to claim 8 wherein said liner includes a first region having an outside diameter of a first distance and a second region having an outside diameter of a second distance, where said first region is disposed above said second region when said pillar is so disposed within the earth's surface, and where the first distance is greater than the second distance.

12. A pier according to claim 5 wherein said liner comprises a substantially cylindrical tube and a collar fashioned of a degradable material that decreases in volume over time when disposed within the earth's surface and wherein said collar surrounds said tube near the upper end thereof when said pillar is so disposed within the earth's surface.

13. A pier according to claim 12 wherein said degradable material comprises cellulose.

14. A pier adapted to support a load comprising:

a concrete pillar having a substantially longitudinal axis adapted for disposition within the earth's surface such that the longitudinal axis thereof is substantially vertically oriented;

a tube having a substantially longitudinal axis;

means for securing said tube to the top of said pillar such that the longitudinal axis of said tube extends substantially perpendicular to the longitudinal axis of said pillar with a portion of said tube extending beyond the periphery of said pillar and adapted to bear substantially the entire load supported by the pier, said securing means comprising at least one threaded rod embedded in said concrete pillar and wherein said rod extends upwardly through said tube, and wherein said securing means further comprises a nut adapted to be threadably mounted on said threaded rod such that said tube rests against the top of said concrete pillar; and a liner surrounding a substantial portion of the periphery of said pillar along at least a portion of the longitudinal length of said pillar, whereby said liner inhibits the movement or swelling of the earth's surface surrounding said liner from displacing said pillar.

15. A liner for surrounding at least the upper portion of a substantial portion of the periphery of and along a substantial length of the longitudinal length of a pillar within the earth's surface, said liner comprising a deformable sheet of plastic capable of assuming a shape whereby the sheet may surround the pillar portion, said liner having a substantially continuous and smooth interior surface abutting and contacting said pillar periphery portion, said liner displaceable and translatable relative to both said pillar and the earth's surface surrounding said liner, whereby when said liner surrounds the pillar portion, said liner inhibits the movement or swelling of the earth's surface surrounding said liner from displacing said pillar.

16. A pier adapted to support a load comprising:

a concrete pillar having a substantially longitudinal axis adapted for disposition within the earth's surface such that the longitudinal axis thereof is substantially vertically oriented;

a support tube having a substantially longitudinal axis, said support tube adapted to bear substantially the entire load supported by the pier;

means for securing said tube to said pillar such that the longitudinal axis of said tube extends substantially perpendicular to the longitudinal axis of said pillar; and a liner comprising a plastic tube surrounding at least the upper portion of a substantial portion of the periphery of said pillar along a substantial length of the longitudinal length of said pillar, said liner having a substantially continuous and smooth interior surface abutting and contacting said pillar periphery portion, said liner displaceable and translatable relative to both said pillar and the earth's surface surrounding said liner, whereby said liner inhibits the movement or welling of the earth's surface surrounding said liner from displacing said pillar.

17. A pier adapted to support a load comprising:

a concrete pillar having a substantially longitudinal axis adapted for disposition within the earth's surface such that the longitudinal axis thereof is substantially vertically oriented;

an arm having a substantially longitudinal axis;

means for securing said arm to the top of said pillar such that the longitudinal axis of said arm extends substantially perpendicular to the longitudinal axis of said pillar, at least a portion of said arm extending beyond the periphery of said pillar and adapted to bear substantially the entire load supported by the pier, said securing means including reinforcement means for maintaining the strength and integrity of said pillar, said reinforcement means in intimate contact with said pillar and extending a substantial distance along the longitudinal length of said pillar.

18. A pier adapted to support a load according to claim 17 wherein said arm consists essentially of a material other than concrete.

19. A pier according to claim 17 wherein said arm and said reinforcement means each consist essentially of metal.

20. A pier according to claim 17 wherein said reinforcement means includes at least one rod embedded within said pillar.

* * * * *